US005718267A

United States Patent [19]

Kawabata et al.

[11] Patent Number: 5,718,267

[45] Date of Patent: Feb. 17, 1998

[54] TUCK-IN SELVAGE FORMING DEVICE FOR A LOOM

[75] Inventors: Eiji Kawabata; Akihiko Nakada, both of Kanazawa, Japan

[73] Assignee: Tsudakoma Kogyo Kabushiki Kaisha, Ishikawa-ken, Japan

[21] Appl. No.: 725,202

[22] Filed: Sep. 20, 1996

[30] Foreign Application Priority Data

Oct. 16, 1995 [JP] Japan ..... 7-293434

[51] Int. Cl.[6] ..... D03D 47/48

[52] U.S. Cl. ..... 139/434; 139/116.2

[58] Field of Search ..... 139/434, 116.2

[56] References Cited

U.S. PATENT DOCUMENTS

| | | | |
|---|---|---|---|
| 4,142,559 | 3/1979 | Sbabo | 139/434 |
| 4,972,881 | 11/1990 | Umezawa et al. | 139/434 |
| 5,431,195 | 7/1995 | Corain et al. | 139/434 |

FOREIGN PATENT DOCUMENTS

| | | |
|---|---|---|
| 243908 | 11/1990 | Japan . |
| 345975 | 9/1991 | Japan . |

*Primary Examiner*—Andy Falik
*Attorney, Agent, or Firm*—Darby & Darby

[57] ABSTRACT

In a tuck-in selvage forming device for a high speed loom, a weft holder with a cutter, hereinafter referred to as a "capturing-cutting head", is connected via a transmission system to a drive source of the loom. The capturing-cutting head reciprocates between an operative position and a stand-by position in synchronism with the running of the loom. By operation of a spring inserted in the transmission system, the capturing-cutting head is biased toward the operative position. A stopper activated by a faulty weft signal disenables the spring, so that the capturing-cutting head is held in the stand-by position, i.e., so that reciprocation of the capturing-cutting head is prevented despite continued operation of the drive source.

3 Claims, 6 Drawing Sheets

TUCK-IN SELVAGE FORMING DEVICE FOR A LOOM

BACKGROUND OF THE INVENTION

The present invention relates to a tuck-in selvage forming device for a loom, and more particularly relates to improvement in automatic operation at occurrence of faulty weft insertion in a process to fix a selvage of a fabric by drawing a weft projecting from the selvage into an open shed via cooperation of a weft holder and a cutter with a needle.

In the following paragraphs, a combination of a weft holder with a cutter is referred to as "a capturing-cutting head". Further, regarding arrangements and movements of various elements, the spots on the side of the capturing-cutting head will hereinafter be referred to with terms such as "front" and "forwards".

In operation of a tuck-in unit, a capturing-cutting head is driven for reciprocation between an operative position and a stand-by position in synchronism with running of a loom for which the capturing-cutting head is used. More specifically, a weft projecting from a selvage of a fabric after weft insertion is captured by a weft holder, cut by a cutter and drawn into an open shed by operation of a needle. During this process, operations of a capturing-cutting head are carried out in synchronism with rotation of the main shaft of a loom to which the capturing-cutting head is mounted. A stop signal is issued at the occurrence of each faulty weft insertion to stop the running of the loom. However, due to inertia the loom performs about one crank cycle rotation even after issue of the stop signal. This inertia rotation of the loom causes the concomitant operation of the capturing-cutting head to cut a faulty weft.

When the loom is installed with a faulty weft auto-remover which performs automatic removal of a faulty weft, the above-described inertia operation of the capturing-cutting head complicates operation of the auto-remover or, in the worst case, disenables the auto-remover. This is because a faulty weft to be removed is divided into two pieces by the inertia operation of the capturing-cutting head. In particular, in the case of a center tuck-in unit used for multi-fabric weaving in which a plurality of fabrics are woven concurrently in a side-by-side fashion, such inertia operation of the capturing-cutting head cuts a faulty weft into several pieces. Such multiple cutting of a faulty weft may disenable the faulty weft auto-remover.

It is thus highly desirable in the field of tuck-in units not to cut a faulty weft when faulty weft insertion has occurred. Several expedients have already been proposed in the field in order to achieve such an end.

Japanese Utility Model Publication Hei.2-43908 discloses a combination of a clutch with a brake which is employed in a driving system for a capturing-cutting head. As faulty weft insertion begins, a clutch opens and a brake is activated to prohibit operation of the capturing-cutting head. In this conventional construction, a large braking force is necessitated in order to assure a reliable braking operation. When the running speed of a loom is accelerated the operation speed of an associated tuck-in unit is also accelerated, and operation of the disclosed arrangement cannot be sustained at such high speed running of the loom. In addition, troublesome adjustment is necessitated to permit the correct meshing of clutch teeth when the clutch is closed. Incorrect meshing of the clutch teeth would cause breakage of related mechanical elements.

Japanese Utility Model Publication Hei.3-45975, discloses a faulty weft which is forced to stay out of the operation ambit of a capturing-cutting head when faulty weft insertion has started. This system is, however, subject to the disadvantage that the faulty weft is liable to be cut before it escapes from the operation ambit of the capturing-cutting head. In particular, in the case of the above-described center tuck-in unit used for multi-fabric weaving, the faulty weft is held between neighboring fabrics. In such a position, the faulty weft tends to further this disadvantageous tendency. As a consequence, no reliable escape of the faulty weft from undesirable cutting can be expected.

SUMMARY OF THE INVENTION

It is thus the basic object of the present invention to assure reliable escape of a faulty weft from undesirable cutting on a tuck-in unit even under the condition of high speed running of an associated loom.

It is another object of the present invention to enable reliable escape of a faulty weft from undesirable cutting without any need for complicated adjustment.

In accordance with the basic aspect of the present invention, a spring is provided to drive a capturing cutting head for a movement to an operative position. On receipt of a faulty weft signal the action of the spring is inhibited by a stopper and movement of the capturing-cutting head to an operative position is stopped through engagement of the stopper with an element fixedly connected to the capturing-cutting head.

DESCRIPTION OF THE PREFERRED EMBODIMENTS

One embodiment of the tuck-in selvage forming device in accordance with the present invention is shown in FIGS. 1 to 4, in which an intermediate element 19 is elastically pressed against a drive cam by a spring and a solenoid-type stopper pin is arranged near the moving ambit of the intermediate element. On receipt of a faulty weft signal, the stopper pin is brought into engagement with the intermediate element and provisionally holds the same out of the operation ambit of the drive cam against operation of the above-described spring.

Figure 1:
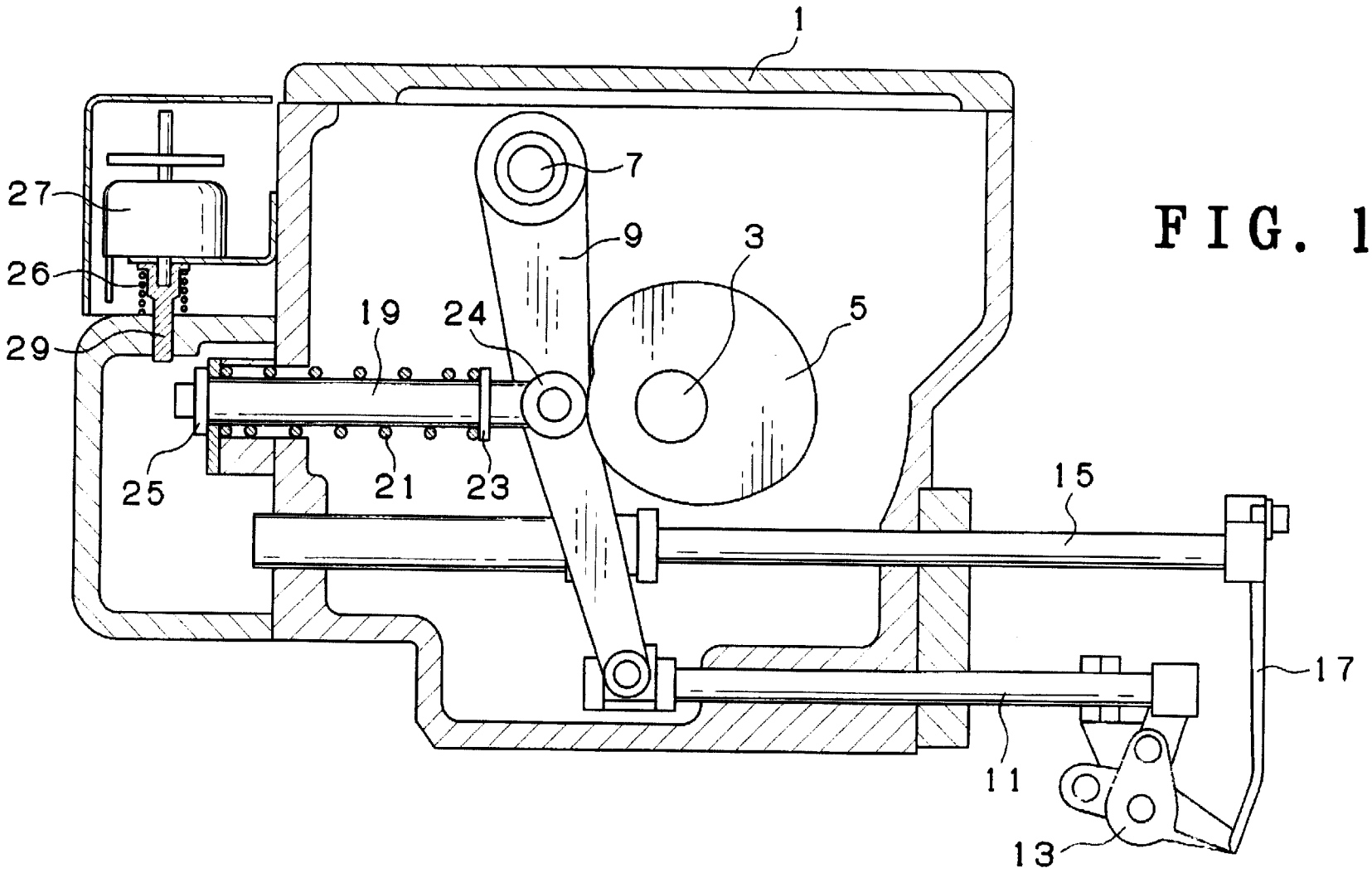
FIG. 1 is a side view, partly in section, of one embodiment of the tuck-in selvage forming device in accordance with the present invention under the condition of normal weft insertion.

In FIG. 1, a drive shaft 3 is rotatably supported within a framework 1 and fixedly carries a drive cam 5. The drive shaft 3 is designed to rotate in synchronism with running of an associated loom. At a position somewhat above the drive shaft 3, a pin 7 is fixed to the framework 1 while projecting in parallel to the drive shaft 3. A vertically extending swing lever 9 is pivoted at its upper end to the pin 7 while its lower end is pivoted to a holder rod 11 which extends horizontally forwardly through the framework 1 in an axially reciprocal arrangement. The holder rod 11 carries at its front end a capturing-cutting head 13 outside the framework 1. A needle rod 15 also extends forwardly in parallel to the holder rod 11 through the framework 1 in an axially reciprocal arrangement. The needle rod 15 carries at its front end a needle 17 outside the framework 1. The needle rod 15 is connected to a known drive system (not shown) which is independent from that for the holder rod 11.

Figure 3:
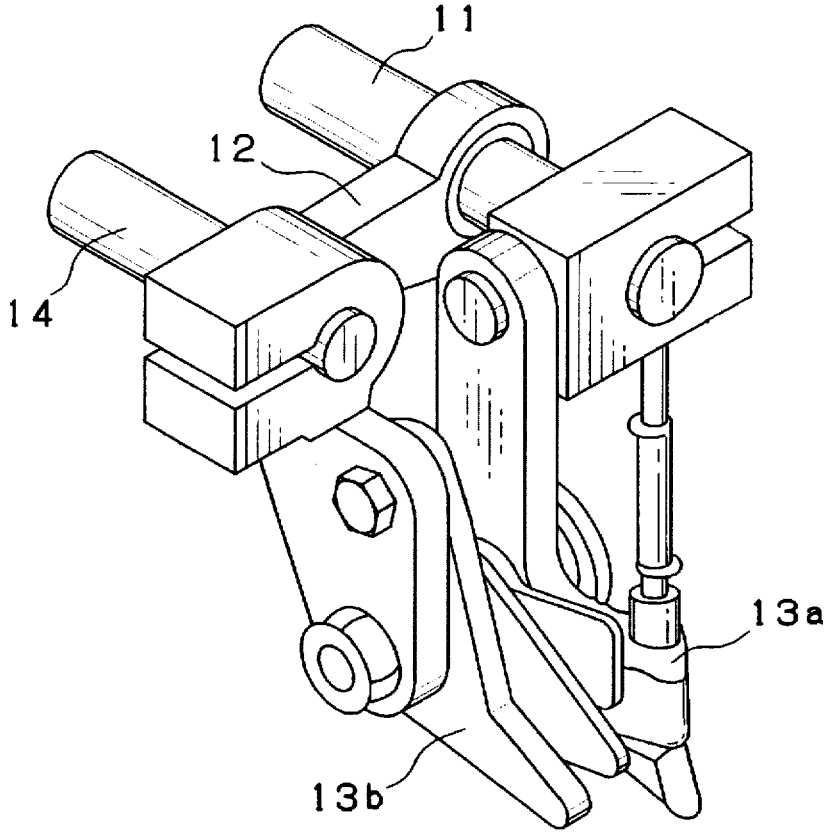
FIG. 3 is a perspective view of one example of the capturing-cutting head utilized by the device in accordance with the present invention.
Figure 4:
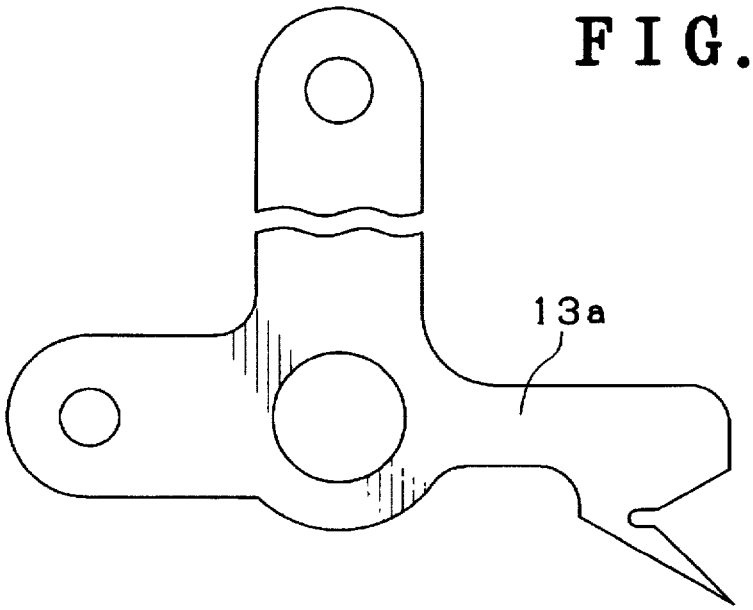
FIG. 4 is an enlarged side view of the weft holder.

One example of the capturing-cutting head 13 and its related elements is shown in FIG. 3, in which the capturing-cutting head 13 includes a holder 13*a* and a cutter 13*b*. These elements are both mounted together to the front end of the holder rod 11. One example of the holder 13*a* is shown in FIG. 4. The cutter 13*b* is carried by the holder rod 11 via a bracket 12 and further connected to a cutter shaft 14.

On the rear side of the drive cam 5, an operation rod 19 is supported by the framework 1 in an axially reciprocal arrangement. This rod 19 extends horizontally in parallel to the holder rod 11. The operation rod 19 forms the above-described intermediate element and its front end is pivoted to the body of the swing lever 9 while rotatably carrying a cam follower 24. Two collars 23, 25 are integrally formed on the operation rod 19 near its front and rear ends. A compression spring 21 is interposed between the front collar 23 and the framework 1. As long as no external force is applied, the cam follower 24 is kept in elastic pressure contact with the drive cam 5 by operation of the compression spring 21. As the drive cam 5 rotates, the swing lever 9 pivots on the pin 7 and the operation rod 19 reciprocates forwardly and rearwardly. Concurrently, the holder rod 11 with the capturing-cutting head 13 reciprocates forwardly and rearwardly.

On the rear upper side of the operation rod 19, a solenoid 27 is mounted to the framework 1 and provided with a stopper pin 29 directed downwardly. This stopper pin 29 is associated with a compression spring 26 so that it is normally biased upwardly by the solenoid 27. On receipt of a faulty weft signal, the solenoid 27 is activated to push the stopper pin 29 downwardly. The solenoid 27 is arranged so that the downwardly pushed stopper pin 29 engages the front face of the rear collar 23 when the operation rod 19 is at its rearmost position. This engagement prohibits subsequent forward movement of the operation rod 19.

The above-described tuck-in controller operates in the following fashion.

In the position of the selvage forming device shown in FIG. 1, no faulty weft insertion has started. As the drive cam 5 rotates, the operation rod 19 in elastic pressure contact with the drive cam 5 is driven for axial reciprocation and, concurrently, the swing lever 9 which is pivotally connected to the operation rod 19, swings about the pin 7. Following this swing, the holder rod 11 which pivotally connected to the swing lever 9 also reciprocates forwardly and rearwardly and, concurrently, the capturing-cutting head 13 carried by the holder rod 11 performs a corresponding axial reciprocation in order to capture and cut a faulty weft.

Figure 2:
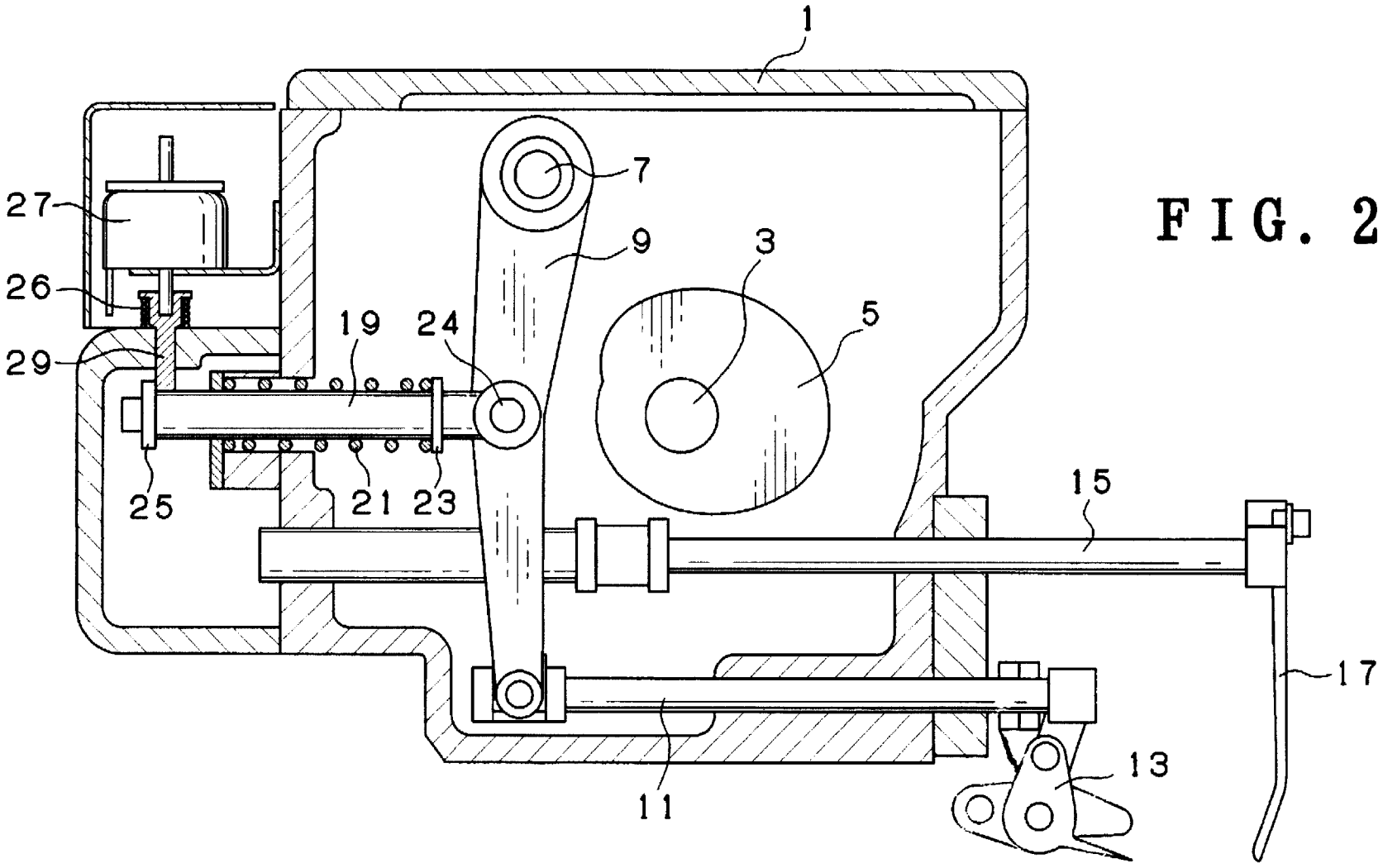
FIG. 2 is a side view, partly in section, of the same device under the condition of faulty weft insertion.

In the position of the device shown in FIG. 2, faulty weft insertion has started and a faulty weft signal has been issued. Being activated by this faulty weft signal, the solenoid 27 pushes its stopper pin 29 downwardly. This movement of the stopper pin 29 is timed to correspond to the rearmost position of the operation rod 19 and, consequently, the stopper pin 29 is brought into engagement with the front face of the rear collar 25 on the operation rod 19. Due to this locking by the stopper pin 29, the cam follower 24 on the operation rod 19 is kept out of the operation ambit of the drive cam 5 against repulsion of the compression spring 21. Stated otherwise, subsequent rotation of the drive cam 5 causes neither corresponding swing of the swing lever 9 nor axial reciprocation of the operation rod 19. That is, the operation rod 19 and the compression spring 21 are both provisionally inhibited. Thus, rotation of the drive cam 5 is not followed by axial reciprocation of the holder rod 11. As a result, the capturing-cutting head 13 performs neither capturing nor cutting of a faulty weft.

Figure 5:
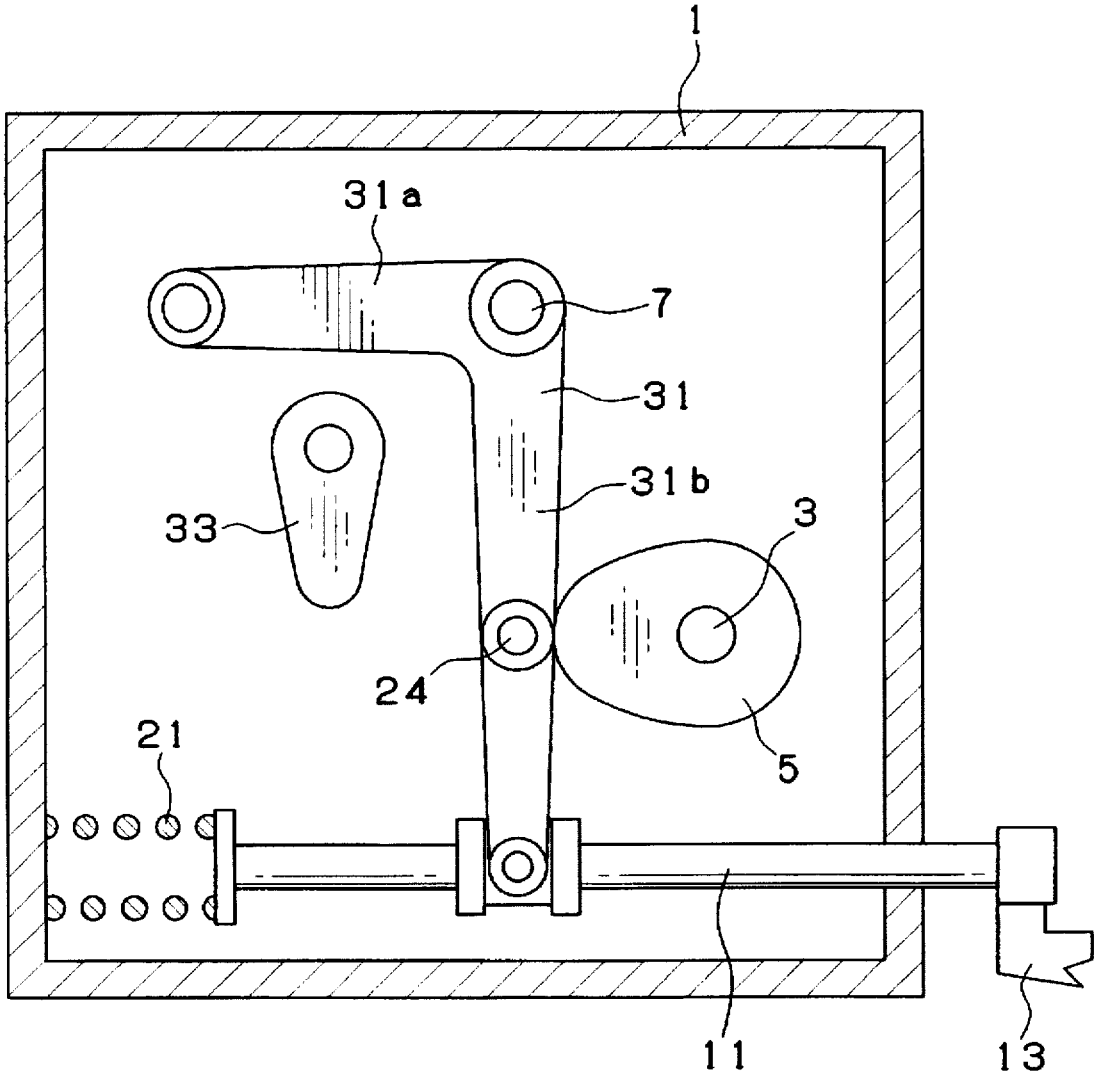
FIG. 5 is a side view, partly in section, of another embodiment of the tuck-in selvage forming device in accordance with the present invention under the condition of normal weft insertion.

Another embodiment of the tuck-in selvage forming device in accordance with the present invention is shown in FIG. 5, in which elements substantially the same in function as those shown in FIGS. 1 to 4 are indicated with same reference numerals and their corresponding descriptions are omitted in the following paragraphs. In the case of this embodiment, an intermediate element is elastically pressed against a drive cam by assistance of a spring and a stopper cam is arranged in the moving ambit of the intermediate element. On receipt of a faulty weft signal, the stopper cam is brought into engagement with the intermediate element and selectively holds the same out of the operation ambit of the drive cam against operation of the above-described spring.

More specifically in FIG. 5, a bifurcate lever 31 is pivoted at its apex on a pin 7. The upper branch 31*a* of the bifurcate lever 31 extends rearwardly substantially horizontally. Whereas the lower branch 31*b* extends downwards almost vertically. The lower branch 31*b* is pivotally attached at its lower end to a holder rod 11 and rotatably carries a cam follower 24 on its body. The bifurcate lever 31 forms the above-described intermediate element. A stopper cam 33 is arranged under the upper branch 31*a* of the bifurcate lever 31. This stopper cam 33 is associated with a suitable known drive system (not shown) which, on receipt of a faulty weft signal, drives the stopper cam 33 for rotation to push up the upper branch 31*a* of the bifurcate lever 31. The holder rod 11 is provided at its rear end with a spring seat 35 and a compression spring 21 is interposed between the spring seat 35 and the framework 1. The compression spring 21 is biased to hold, via the holder rod 11 and the bifurcate lever 31, the cam follower 24 in elastic pressure contact with the drive cam 5 as long as no external force acts.

In the position shown in FIG. 5, no faulty weft insertion has started and, as a consequence, the stopper cam 33 is not in operation. As the drive cam 5 is driven for rotation, the bifurcate lever 31 swings about the pin 7 and the holder rod 11 reciprocates forwardly and rearwardly together with a capturing-cutting head 13 so that the latter captures and cuts a faulty weft.

At an occurrence of a faulty weft insertion, a faulty weft signal drives the stopper cam 33 for rotation to push up the upper branch 31*a* of the bifurcate lever 31. As a result, the bifurcate lever 31 is forced to swing clockwise against repulsion of the compression spring 21 so that the cam follower 24 is brought out of the operation ambit of the drive cam 5. Following this swing of the bifurcate lever 31, the holder rod 11 with the capturing-cutting head 13 is brought to and locked at its rearmost position. As a consequence, subsequent rotation of the drive cam 5 does not cause corresponding operation of the capturing-cutting head 13 and no faulty weft is cut.

Figure 6:
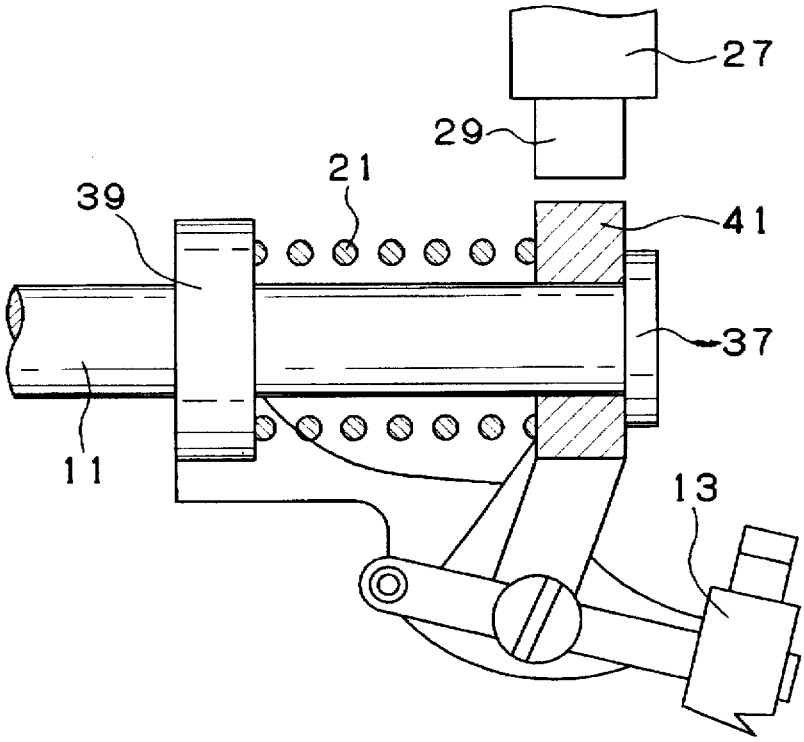
FIG. 6 is an enlarged side view, partly in section, of the main pan of the other embodiment of the tuck-in selvage forming device in accordance with the present invention under the condition of normal weft insertion.
Figure 7:
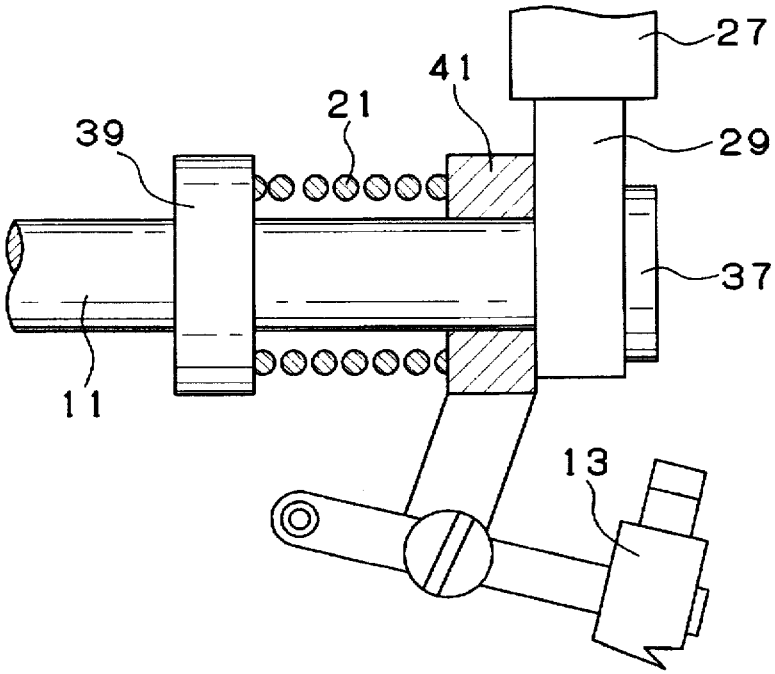
FIG. 7 is an enlarged side view, partly in section, of the main pan of a further embodiment of the tuck-in selvage forming device in accordance with the present invention under the condition of faulty weft insertion.

Another embodiment of the tuck-in selvage forming device in accordance with the present invention is shown in FIGS. 6 and 7. A holder rod carries a capturing-cutting head via a sleeve idly inserted thereover. A spring is interposed between the holder rod and the sleeve so that the sleeve follows axial reciprocation of the holder rod. On receipt of a faulty weft signal, a stopper pin is brought into engagement with the sleeve to deter the sleeve from following axial reciprocation of the holder rod.

In the arrangement shown in FIG. 6, a holder rod 11 is provided near its front end with a pair of collars 37 and 39 spaced in the axial direction from each other. A sleeve 41 is idly inserted over the holder rod 11 between these collars 37 and 39. The sleeve 41 carries a capturing-cutting head 13 projecting downwardly and forwardly. A compression spring 21 is interposed between the sleeve 41 and the rear collar 39 to push the sleeve 41 toward the front collar 37. A spring of a high spring constant is preferably used.

Above the front end of the holder rod 11 at the foremost position, there is arranged a solenoid 27 having a stopper pin 29 directed downwardly. On receipt of a faulty weft signal, the solenoid 27 is activated to push the stopper pin 29 downwardly. The arrangement is designed so that, when the holder rod 11 is at its foremost position, the stopper pin 29 projects downwardly between the sleeve 41 and the front collar 37 in order to deter the sleeve 41 from following axial reciprocation of the holder rod 11.

Under the condition shown in FIG. 6, no faulty weft insertion has occurred and the stopper pin 29 is out of operation. As the holder rod 11 moves forwardly, the compression spring 21 suffers substantially no deformation because of its high spring constant and, being pushed by the rear collar 39, the sleeve 41 moves together with the capturing-cutting head 13. As the holder rod 11 moves rearwardly, the sleeve 41 with the capturing-cutting head 13 moves rearwardly while being pushed by the front collar 37. As a result, a faulty weft is captured and cut by the capturing-cutting head 13.

Under the condition shown in FIG. 7, faulty weft insertion has started and the stopper pin is in operation. On receipt of a faulty weft signal, the solenoid 27 is activated to push the stopper pin 29 downwardly to a position between the sleeve 41 and the front collar 37.

As the holder rod 11 moves forward in this state, the sleeve 41 cannot follow the movement due to hindrance by the stopper pin 29 and therefore the compression spring 21 is compressed between the rear collar 39 and the sleeve 41. That is, the sleeve 41 slides relative to the holder rod 11. The front collar 37 moves forwardly away from the stopper pin 29.

As the holder rod 11 moves rearwardly, the sleeve 41 again slides relative to the holder rod 11. The sleeve 41 remains stationary but the front collar 37 moves towards the stopper pin 29. Stated otherwise, the sleeve 41 and the capturing-cutting head 13 do not follow axial reciprocation of the holder rod 11. As a result, no faulty weft is captured and cut by the capturing-cutting head 13.

Figure 8:
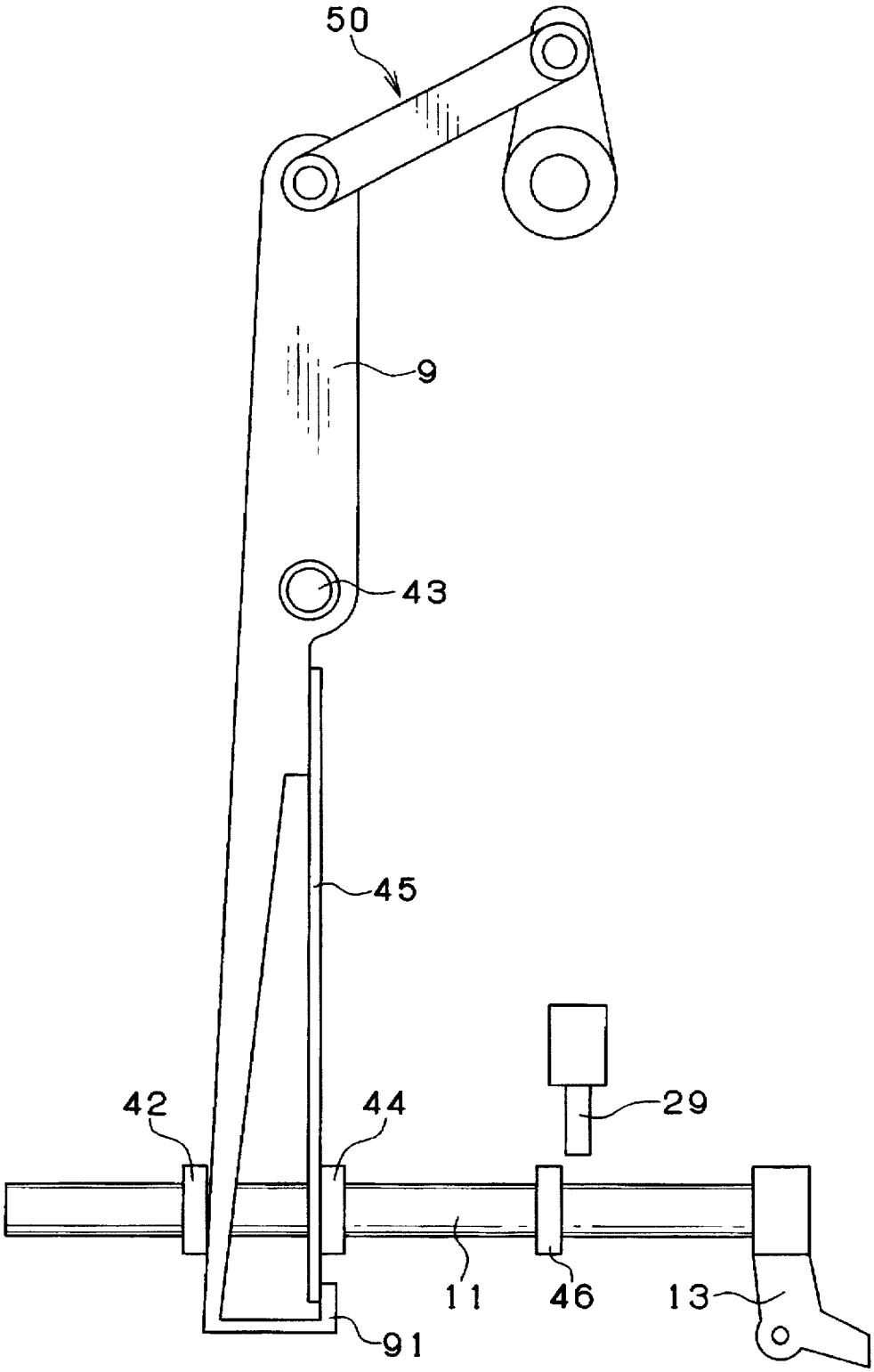
FIG. 8 is a side view of a further embodiment of the tuck-in selvage forming device in accordance with the present invention.

A further embodiment of the tuck-in selvage forming device in accordance with the present invention is shown in FIG. 8. A spring for driving a capturing-cutting head is arranged in a transmission system from a drive source to the capturing-cutting head. This embodiment is substantially the same in operation principle as that shown in FIGS. 6 and 7. In the case of the foregoing embodiment, the compression spring 21 is arranged on the holder rod 11 which performs a linear reciprocation. In contrast to such an arrangement, a spring is arranged on a swing lever in the case of the instant embodiment.

A swing lever 9 is pivoted about the middle of its length to a fixed pin 43 on the framework of the device while extending substantially vertically. The top end of the swing lever 9 is connected in operation to a crank mechanism 50 which operates in synchronism with running of an associated loom. The lower end of the swing lever 9 is bent forwardly to form an upright hook 91. A leaf spring 45 is fixed at a top end to the swing lever 9 at a level just below the fixed pin 43, and at a lower end is in pressure contact with the lower hook 91 of the swing lever 9. A holder rod 11 is arranged for horizontal reciprocation idly through lower sections of the swing lever 9 and the leaf spring 45. At the front end the holder rod 11 fixedly carries a capturing-cutting head 13. The holder rod 11 is provided with 3 sets of fixed collars 42, 44 and 46. The rear collar 42 is arranged on the rear side of the lower section of the swing lever 9 and the middle collar 44 is arranged in contact with the front face of the rear section of the leaf spring 45. A stopper pin 29 is arranged on the front side of the front collar 46 in an arrangement such that it is brought into engagement with the front face of the front collar 46 when activated by a faulty weft signal.

When no faulty weft insertion has started, the stopper pin 29 is out of operation and the capturing-cutting head 13 is driven for normal reciprocation. More specifically, as the swing lever 9 swings counterclockwise in the illustration, the lower section of the leaf spring 45 moves forwardly to push the holder rod 11 forwardly via the middle collar 44. Thus, the capturing-cutting head 13 is brought to the operative position. As the swing lever 9 swings clockwise, the lower section of the swing lever 9 moves rearwardly to push the holder rod 11 rearwardly via the rear collar 42. Thus, the capturing-cutting head 13 is brought to the stand-by position.

When a faulty weft insertion has started, the stopper pin 29 is activated by a faulty weft signal and brought into engagement with the front collar 46 to inhibit its forwardly movement beyond the position of the stopper pin 29.

As the swing lever 9 swings counterclockwise under this condition, the lower section of the leaf spring 45 tends to push the holder rod 11 forwards via the middle collar 44. Since no forward movement is allowed for the holder rod 11 due to engagement with the stopper pin 29 now in operation, the leaf spring 45 is forced to warp towards the lower section of the swing lever 9 to absorb a movement transmitted from the crank mechanism 50. Thus, despite a continued operation of the crank mechanism 50, i.e. the drive source, the capturing-cutting head 13 is not registered at the operative position and no faulty weft is captured and cut by the capturing-cutting head 13.

In the case of the foregoing embodiment, the capturing-cutting head is driven for movement as one unit. However, the holder and the cutter may be driven separately. When a strong synthetic yarn is used for wefts, cutting by the cutter is prohibited but the holder is allowed to move forwards. Then, movement of the holder pushes a faulty weft from the cloth-fell towards the reed out of engagement with warps.

This state of the faulty weft is quite suited for automatic removal of the faulty weft.

In accordance with the present invention, no braking motion is utilized for escape of a faulty weft from undesirable cutting. This system without braking motion can well follow high speed running of the associated loom. Quite different from the conventional clutch system, no complicated timing adjustment is necessitated despite its high degree of reliability in operation.

We claim:

1. A tuck-in selvage forming device for a loom in which a capturing-cutting head is driven for reciprocation between operative and stand-by positions, said device comprising a drive source adapted to operate in synchronism with running of said loom, a spring arranged between said drive source and said capturing-cutting head, said spring biased to urge said capturing-cutting head towards said operative position in response to said drive source, and a solenoid which, on receipt of a faulty weft signal, is activated to push a stopper pin towards an element fixedly connected to said capturing-cutting head, said stopper pin adapted to engage said element so that said capturing-cutting head is selectively held in said stand-by position against the bias of said spring.

2. A tuck-in selvage forming device as claimed in claim 1 in which said drive source includes a cam drive system, and said spring is biased to keep a cam follower in contact with a cam in said cam drive system.

3. A tuck-in selvage forming device as claimed in claim 1 in which a connecting element is arranged in a transmission system from said drive source to said capturing-cutting head in fixed connection to said capturing-cutting head, and said spring is arranged between said drive source and said capturing-cutting head to urge said connecting element carrying said capturing-cutting head towards said operative position.

* * * * *